US007725045B2

(12) United States Patent
Takeyama

(10) Patent No.: US 7,725,045 B2
(45) Date of Patent: May 25, 2010

(54) IMAGE FORMING APPARATUS TO REDUCE A NUMBER OF SIGNAL LINES

(75) Inventor: Yoshinobu Takeyama, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 12/076,283

(22) Filed: Mar. 17, 2008

(65) Prior Publication Data

US 2008/0226309 A1 Sep. 18, 2008

(30) Foreign Application Priority Data

Mar. 16, 2007 (JP) ..... 2007-067706

(51) Int. Cl.
*G03G 15/00* (2006.01)
*G03G 21/00* (2006.01)

(52) U.S. Cl. ..... 399/12; 358/1.15; 399/38

(58) Field of Classification Search ..... 399/9, 399/12, 38, 75, 78; 358/1.15
See application file for complete search history.

(56) References Cited

U.S. PATENT DOCUMENTS 7,321,436 B2 * 1/2008 Asauchi ..... 358/1.15
2007/0065178 A1 3/2007 Shimojo et al. ..... 399/168
2007/0183817 A1 8/2007 Takeyama ..... 399/301
2008/0019710 A1 1/2008 Takeyama ..... 399/12
2008/0212127 A1 * 9/2008 Takeyama ..... 358/1.15

FOREIGN PATENT DOCUMENTS

JP 2002-258691 9/2002
JP 2006-218682 8/2006
JP 2008-012830 A * 1/2008

* cited by examiner

*Primary Examiner*—Sophia S Chen
(74) *Attorney, Agent, or Firm*—Harness, Dickey & Pierce, P.L.C.

(57) ABSTRACT

An image forming apparatus is capable of reducing the vast amounts of image forming apparatus input lines by placing detection data from a plurality of detectors on a single signal line. An image forming apparatus may include an image forming controller configured to control a movement of the image forming apparatus, plural drivers configured to drive plural actuators, an identification controller configured to be coupled to a data signal line, an identification signal line and a term signal line, wherein the identification controller is configured to identify one of the plural drivers based on a term signal and an identification signal that are output from the image forming controller, and to output a driving signal from the image forming controller to the identified driver.

6 Claims, 9 Drawing Sheets

| | IDENTI-FICATION SIGNAL 2 | IDENTI-FICATION SIGNAL 1 | IDENTI-FICATION SIGNAL 2 | IDENTI-FICATION SIGNAL 1 | IDENTI-FICATION SIGNAL 2 | IDENTI-FICATION SIGNAL 1 | IDENTI-FICATION SIGNAL 2 | IDENTI-FICATION SIGNAL 1 |
|---|---|---|---|---|---|---|---|---|
| VALUE OF COUNT | 0 | 0 | 0 | 8 | 3 | 11 | 15 | 15 |
| CONVERSION CODE | 0000 | 0000 | 0000 | 1000 | 0011 | 1011 | 1111 | 1111 |
| IDENTI-FICATION ID | 0 | 8 | 59 | 255 | | | | |

| IDENTIFICATION NUMBER | I/O |
|---|---|
| 1 | DETECTOR a |
| 2 | DETECTOR b |
| 3 | DRIVER a |
| 4 | DRIVER b |
| . | . |
| . | . |
| . | . |
| n | DRIVER n |
| n+1 | DETECTOR n |
| . | . |
| . | . |
| . | . |
| Y | DRIVER y |
| Y+1 | DRIVER y |
| Y+2 | DETECTOR z |

IMAGE FORMING APPARATUS TO REDUCE A NUMBER OF SIGNAL LINES

PRIORITY PARAGRAPH

This application claims priority under U.S.C. §119 to Japanese Patent Application No. 2007-067706, filed on Mar. 16, 2007, in the Japanese Property Office (JPO), the entire contents of which are incorporated herein by reference.

BACKGROUND

1. Field

Example embodiments relate to an image forming apparatus, for example, an electrophotographic copier or inkjet copier, reduces the number of signal lines.

2. Description of the Background Art

Image forming apparatuses, such as digital photo copiers, facsimile machines, laser printers and the like, may be equipped with numerous detachable units, and these units may be provided with sensors as detectors for detecting their respective operating statuses. The detection signals from these sensors may be supplied to a controller (CPUs and so forth) of an image forming apparatus, and the signal lines provided for this purpose may be numerous.

With image-forming apparatuses being equipped with color capabilities, higher performance and/or greater functionality, the number of sensor signal lines has shown a tendency to grow. Further, in addition to detection result signals (data signals), power supplies are also needed to make use of these detectors. Inputting the respective detection signals from a larger number of detectors into a CPU or other such image forming controllers may require a larger number of signal lines and power lines, and image forming controllers may increase in size. Further, because image forming controllers may be provided in locations that are apart from these detectors and respective types of detectors, the larger number of signal lines, as well as the fact that these signal lines may wrap all around inside an apparatus have become bigger obstacles to making such apparatuses simpler, smaller and/or less costly.

Accordingly, a number of proposals have been put forward in the past for solving these problems. One such proposal includes an image forming apparatus, which provides a detachable unit with an I/O expander connected by a serial bus, and which has a controller for identifying the type of a detachable unit by the status of the input port of this I/O expander. In this image forming apparatus, the number of signal lines connecting a unit with the apparatus main body is reduced by identifying the type of unit in accordance with the status of the input port of the I/O expander.

Another proposal includes an image forming apparatus, a forwarding clock is set, when it is L level. The forwarding clock is image serial data, when the forwarding data taken at the time of forwarding data standing up. The forwarding data which stands up is control signal, when it is "H" level. The image serial signal and the control signal are transferred in a common signal line in the image forming apparatus.

However, according to this past proposal for an image forming apparatus, the signal lines for each detachable unit comprise a power line, data line, clock line, and ground line, and when viewed in terms of the apparatus as a whole, signal line reduction is still insufficient.

If the image serial signal and the control signal are transferred in a common signal line in the image forming apparatus, the signal line which is input and output to the image forming controller becomes larger.

Another problem is that when the system configuration (number of input/output devices) changes, suitable control must be provided, leading to higher costs.

FIG. 11 shows an example of a system configuration for a basic engine of an image forming apparatus.

Within the main body of the apparatus of the image forming apparatus shown in FIG. 11, a developer unit 41, photosensitive body unit 42, intermediate transfer unit 43, paper feeding unit 44 and/or fixing unit 45 may be connected as a plurality of detachable units to image forming controllers 40, which may have a CPU (Central Processing Unit). Signals showing the detachable status of these detachable units relative to the apparatus main body may each be input individually as input signals from detectors provided for the respective units. Other input signals include detection signals from detectors such as a temperature/humidity sensor 51 for detecting the temperature and humidity inside and outside the apparatus, a contact separation sensor 52 for detecting location/status information for a contact separation mechanism driven at image formation time, as well as a recording medium and the like, and/or a toner concentration detection sensor 54. Signal lines for a paper size detection sensor 53, which detects the size of a piece of paper, a paper supply cassette sensor and so forth also account for a plurality of bits, and may increase the number of signal lines. Although not shown in FIG. 11, there also may be a high voltage source feedback signal. Furthermore, although not shown in FIG. 11, a motor, clutch/solenoid for driving the mechanical systems may be connected to the image forming controller output devices.

Further, using these detectors may require power supplied in addition to detection result signals (data signals). Inputting the respective detection signals from the plurality of detectors into the image forming controller 40 may require numerous signal lines and power lines, causing image forming controller 40 to increase in size. Further, because image forming controller 40 may be located apart from these detachable units and respective types of detectors, the large number of signal lines, as well as the fact that these signal lines wrap all around inside the apparatus may be obstacles to making the apparatus simpler, smaller and/or less costly.

SUMMARY

Example embodiments provide an image forming apparatus, which is capable of reducing a number of image forming apparatus input lines by placing detection data from a plurality of detectors on a single signal line, and which also possesses the versatility and cost-reducing capabilities to be able to deal with changes in the image forming system configuration, without increasing the number of signal lines by making detectors identification signals redundant. And the number of signal lines is not increased, when the system configuration (number of input/output devices) changes.

In example embodiments, an image forming apparatus may include an image forming controller configured to control a movement of the image forming apparatus, plural drivers configured to drive plural actuators, an identification controller configured to be coupled to a data signal line, an identification signal line and a term signal line, wherein the identification controller is configured to identify one of the plural drivers based on a term signal and an identification signal that are output from the image forming controller, and to output a driving signal from the image forming controller to the identified driver.

BRIEF DESCRIPTION OF THE DRAWINGS

The above and other objects, features and advantages of example embodiments will become more apparent from the following detailed description taken with the accompanying drawings in which.

DESCRIPTION OF EXAMPLE EMBODIMENTS

Figure 1:
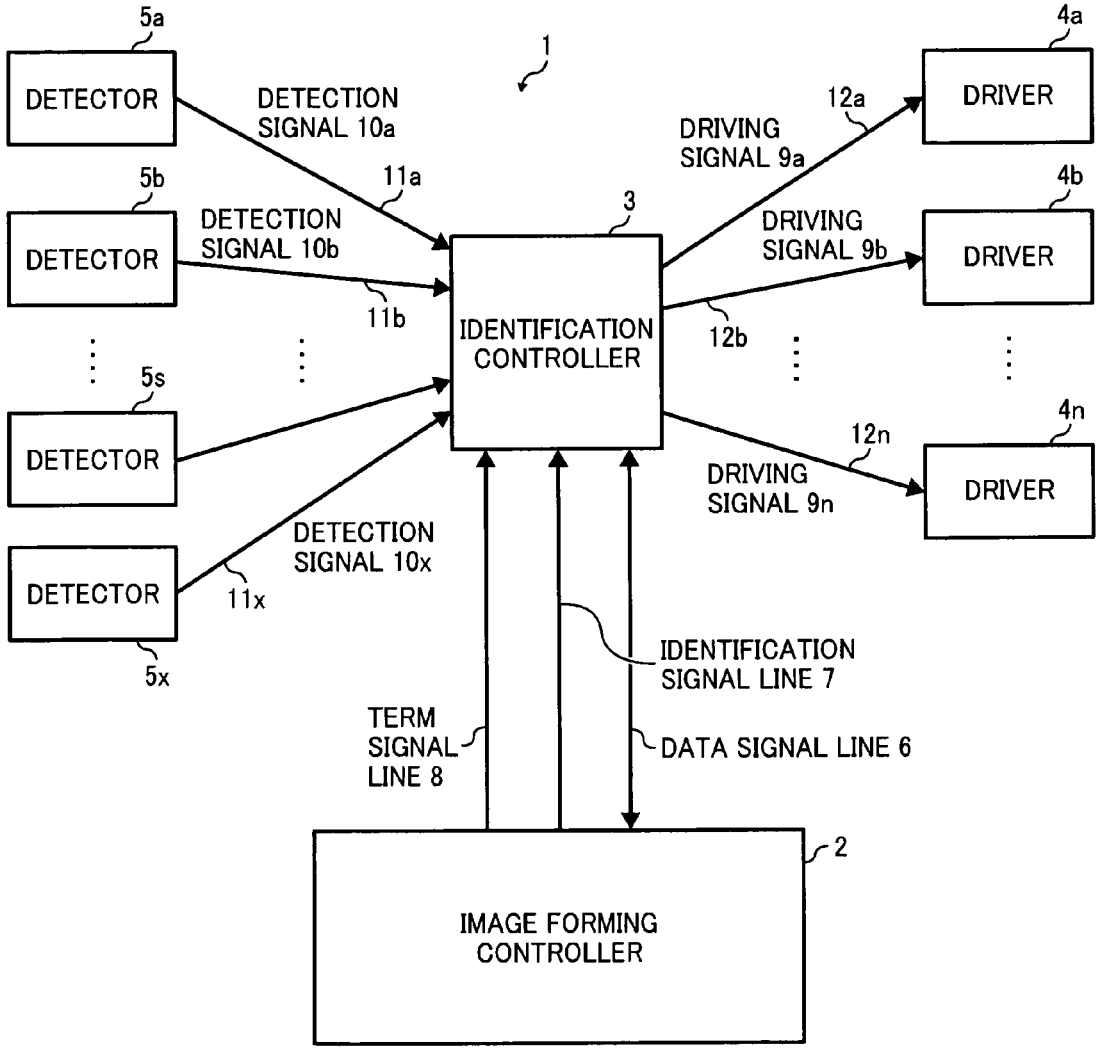
FIG. 1 is a block diagram showing a system configuration for a basic engine of an image forming apparatus in accordance with example embodiments.

Hereinafter, example embodiments will be described in detail with reference to the attached drawings. Reference now should be made to the drawings, in which the same reference numerals are used throughout the different drawings to designate the same or similar components. In the drawings, the thicknesses and widths of layers are exaggerated for clarity. Example embodiments may, however, be embodied in many different forms and should not be construed as limited to the example embodiments set forth herein. Rather, these example embodiments are provided so that this disclosure will be thorough and complete, and will fully convey the scope of example embodiments to those skilled in the art.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Like numbers indicate like elements throughout. As used herein the term "and/or" includes any and all combinations of one or more of the associated listed items.

It will be understood that, although the terms "first", "second", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

An image forming apparatus may include an image forming controller 2, an identification controller 3, a plurality of the drivers 4*a*-4*n* (where n is an integer >1) and/or a plurality of the detectors 5*a*-5*x* (where x is an integer >1) shown in FIG. 1.

The identification controller 3 may be located near the plurality of the drivers 4*a*-4*n* and/or the plurality of detectors 5*a*-5*x*. The identification controller 3 may be coupled to the image forming controller 2, the data signal line 6, the identification signal line 7 and term signal line 8. The data signal line 6, the identification signal line 7 and term signal line 8 may supply data signal(s) 6', identification signal(s) 7' and term signal(s) 8', respectively.

Figure 2:
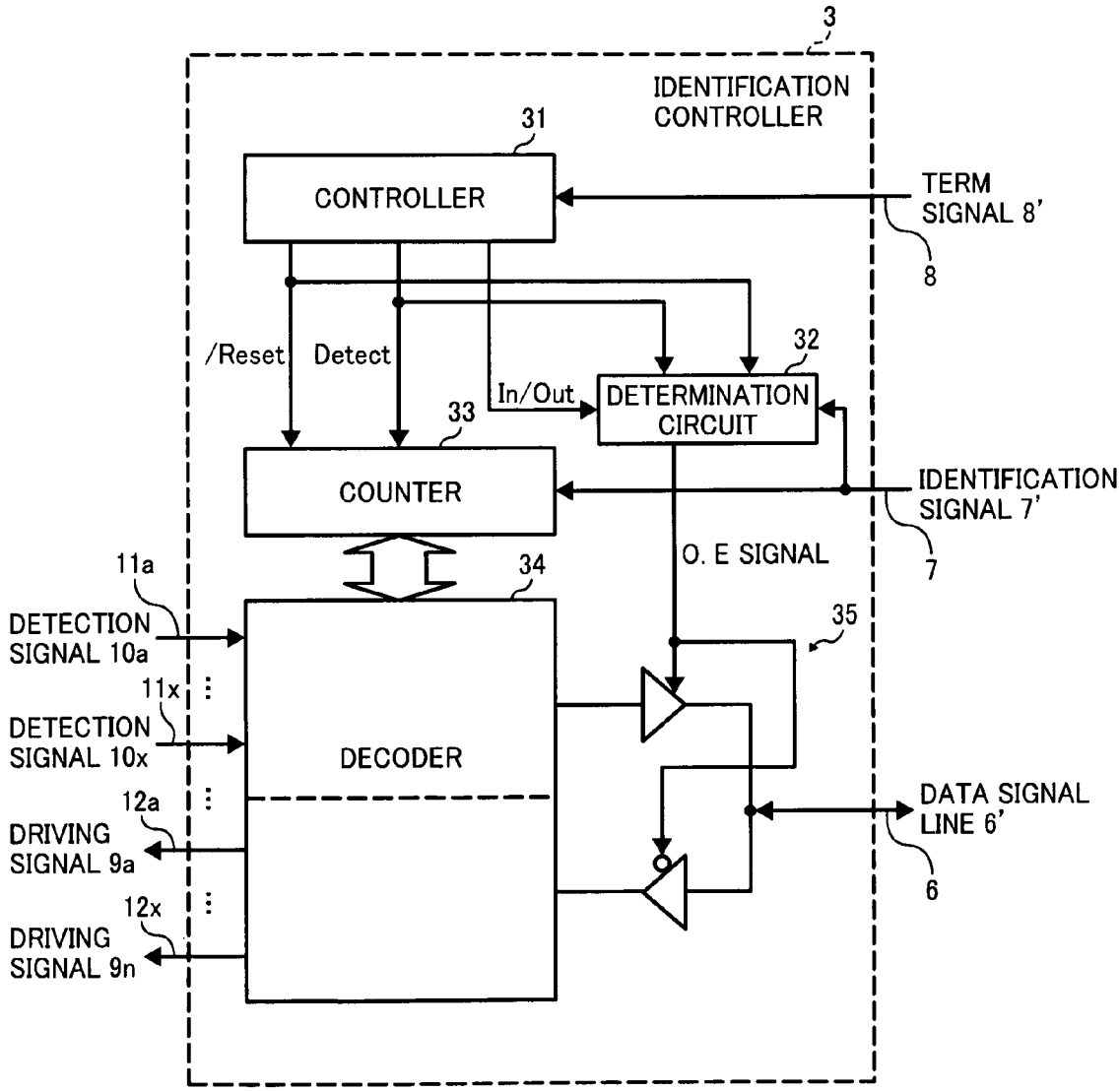
FIG. 2 is a block diagram showing a configuration of a detection identification circuit for an image forming apparatus related to an example embodiments.

The identification controller 3 may include a controller 31, a determination unit 32, a counter 33, a decoder means 34 and/or a data I/O (Input/Output) 35, shown in FIG. 2. The identification controller 3 may identify one of the drivers 4*a*-4*n* by the identification signal 7' and the term signal 8'. The identification signal 7' may be output from the image forming controller 2 to the identification signal line 7. The term signal 8' may be output to the term line 8. The identification controller 3 may output a driver signal 9*n* to a driver 4*n*. The driving signal 9*n* may be output from the image forming controller 2 to the data line 6.

The identification controller 3 may receive input data (for example, binary input data) output from the detectors 5*a*-5*x*. Furthermore, the identification controller 3 may receive input data (for example, several bits of serial data) which is the detection signal 10*a*-10*x*. The identification controller 3 identifies the detectors 5*a*-5*x* based on the identification signal 7' output from the image forming controller 2 to the identification signal line 7 and the term signal 8' output from the term signal line 8.

Figure 3:
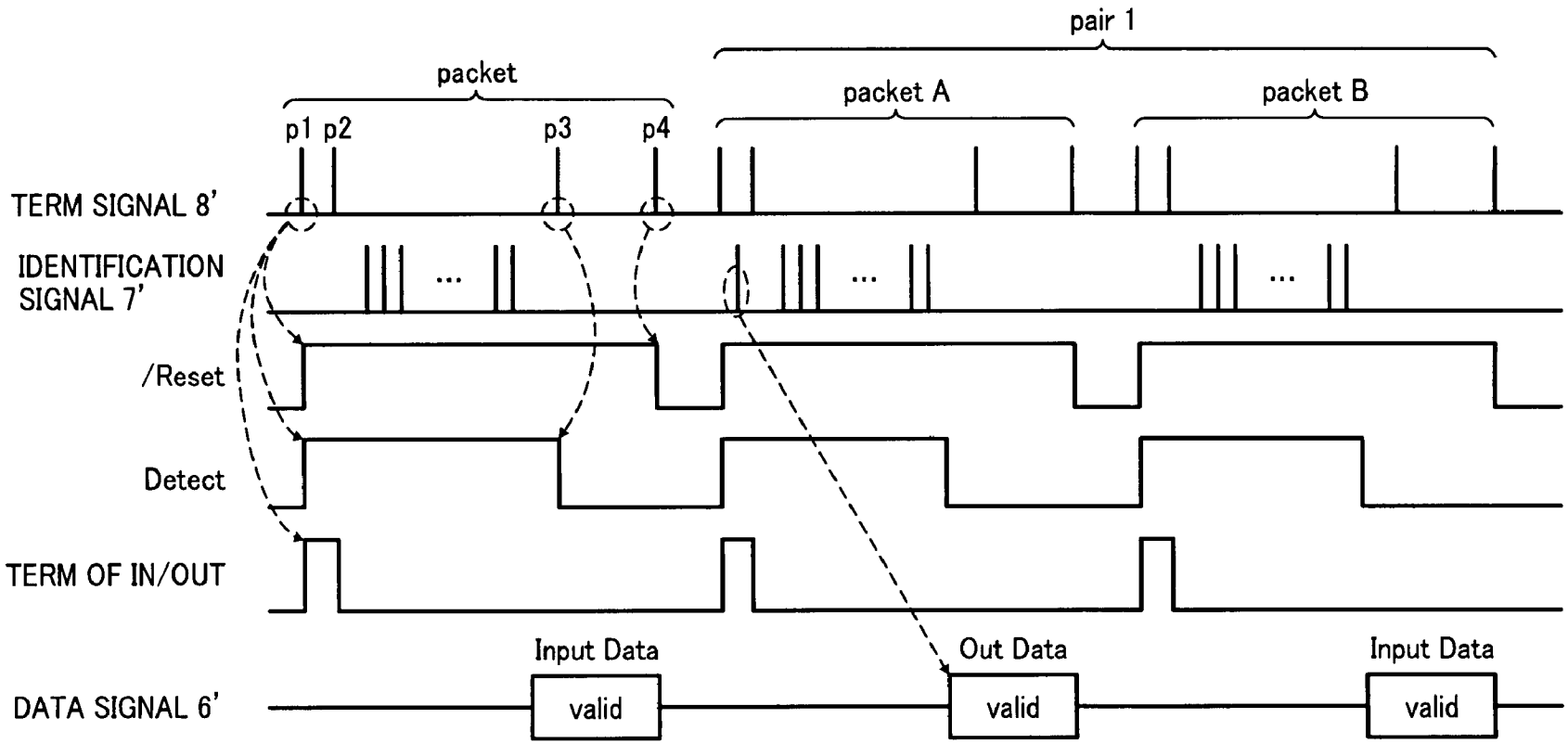
FIG. 3 is an example timing chart that shows the timing of the signal control processed by an identification device.

The term signal 8' may be in the form of a pulse "p1-p4" output from the image forming controller 2 to the term signal line 8 and input to the controller 31 of the identification controller 3, as shown in FIG. 3. The pulse "p1-p2" in the term signal 8' may be the term of the I/O (Input/Output) determination (the TERM OF IN/OUT signal shown in FIG. 3) whether output the driving signal to the driver 4 or input the detection signal of the detector 5. The leading edge of the pulse "p1-p2" also may begin the /RESET signal and/or the Detect signal, shown in FIG. 3.

The pulse "p3-p4" in the term signal 8' may be the date validity term of the data line 6. The identification signal 7' may include one or more identification pulses, which may be output to the identification signal line 7 and input to the determination circuit 32 and the counter 33. The drivers 4*a*-4*n* and the detectors 5*a*-5*x* may be Identified by the number of the identification pulse. The number of the pulse which is the identification signal 7' may be shared by a detector 5*x* and a driver 4*n*, because the term of the I/O (Input/Output) determination may be set up in the term signal 8' immediately before the identification validity term. As a result, it is possible to shorten the identification effective term by reducing the number of identification pulses of the identification signal 7'. Furthermore, it is possible to reduce the scale of the counter 33 which counts the identification pulses.

"p3" also may end the Detect signal and "p4" also may end the /RESET signal, shown in FIG. 3.

The term signal 8', the identification signal 7' and/or the data signal 6' that is generated may form a packet "p1-p4". Furthermore, the number of the identification pulses may be made the same in a pair of the drivers 4*n* and the detectors 5*x*. A driver 4 may be driven by the previous packet "A" made a pair, and the detector 5 is detected by the next packet "B". As a result, the result of a change of driver 4*n* can be confirmed without changing a result of a detector 5*x*.

Figure 4:
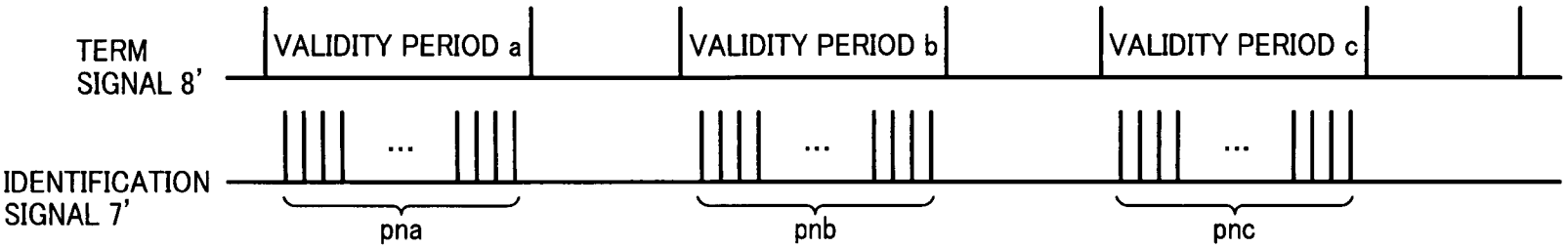
FIG. 4 is an example timing chart that shows the identification pulse of the identification signal that identifies the I/O (Input/Output) device.

FIG. 4 shows an example when the identification controller 3 identifies a driver 4*n* and a detector 5*x*. The identification controller 3 identifies the I/O (Input/Output) in the driver 4*a*-4*n* or the detector 5*a*-5*x* by the number of pulses of the identification signal 7' generated in the term that the identification signal is effective. For example, the identification controller 3 may identify and select the driver 4*a* or the detector 5*a* in the effective term "a" of the identification signal 7', if the number of identification signal is "pna". And the identification controller 3 may identify and select the driver 4*b* or the detector 5*b* in the effective term "b" of the identification signal, if the number of identification signal is "pnb". Also, the identification controller 3 may identify and select the driver 4*c* or the detector 5*c* in the effective term "c" of the identification signal 7', if the number of identification signal is "pnc". In this way, the identification controller 3 makes the pulse of the identification signal correspond to the driver 4 or the detector 5.

The controller 31 of the identification controller 3 may input the pulse "p1-p4" of the term signal 8'. The pulse of the term signal 8' may be output from the image forming controller 2 to the term signal line 8. The controller 31 may generate the Reset signal, Detect signal and/or the term of I/O (Input/Output) signal, as shown in FIGS. 2 and 3.

The Reset signal, the Detect signal and/or the term of I/O (Input/Output) signal may be output to the determination unit 32. The Reset signal and the Detect signal may be output to the counter 33. The determination unit 32 may generate an O.E signal (output enable signal) and control I/O (Input/Output). The O.E signal makes the data on the data line 6 effective by the state of the identification signal line 7 in the term of I/O (Input/Output). The identified I/O (Input/Output) becomes the driver 4, if the driving pulse is generated on the identification signal line 7 in the term of the I/O (Input/Output) of the previous packet "A". And the I/O (Input/Output) may output the driving data of the driver 4 from the image forming controller 2 to the data signal 6. Furthermore, the identified I/O (Input/Output) becomes the detector 5, if the driving pulse is not generated on the identification signal line 7 in the term of the I/O (Input/Output) of the following packet "B". The image forming controller 2 may provide and receive the detect signal which is the data of the effective term on the data line 6.

The counter 33 may count the number of identification ID that is generated as the identification signal 7' of the identification signal line 7 by the controller 31 in identification signal validity term. And the counter 33 may output the value which is the number of identification ID to decoder 34.

The decoder 34 may be coupled to the detector 5*a*-5*x* and the data line 11*a*-11*x*. Furthermore, the decoder 34 may be coupled to the drivers 4*a*-4*n* and data lines 12*a*-12*n*. The decoder 34 may recognize and select one of the drivers 4*n* and the detectors 5*x*. The decoder 34 outputs the data which loads from data line 6 in the data effective term. The data is the driving signal 9 output via data line 12 by the decoder 34. The decoder 34 may output the data 10 which is output via the data line 12 by detector 5. The data 10 may be output to the data line 6 based on the signal of O.E.

Figure 5:
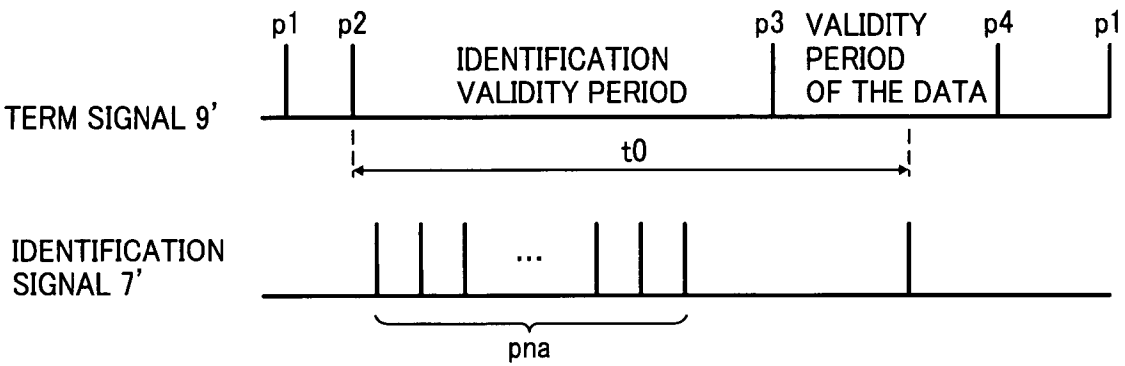
FIG. 5 is an example timing chart that shows timing in which the data of driving signal is assumed to be effective.

FIG. 5 shows the timing in which the data of driving signal is assumed to be effective. The data on the data line 6 becomes effective because of standing up the pulse "p3" of signal term. The data on the data line is taken constant timing from the pulse of "p3" to the pulse of "p4", if accuracy is not demanded from driving timing. And the data is output to corresponding driver 4. However, the pulse is transferred to identification signal line 7 at the time of "t0" in the timing from the pulse of "p3" to the pulse of "p4", if strictness is demanded from driving timing. And the data on the data line 6 is output to corresponding driver 4 by the pulse. Thus, the driving timing may be adjusted. For example, the data on the data line 6 may become "H" in the effective term and transferred pulse to the identification signal line 7 at the desirable timing, if the DC motor stops driving or the solenoid is OFF. The data in the effective term becomes "L" and the pulse is generated at the desirable timing, if the DC motor stop driving or the solenoid is OFF.

Figures 6, 7:
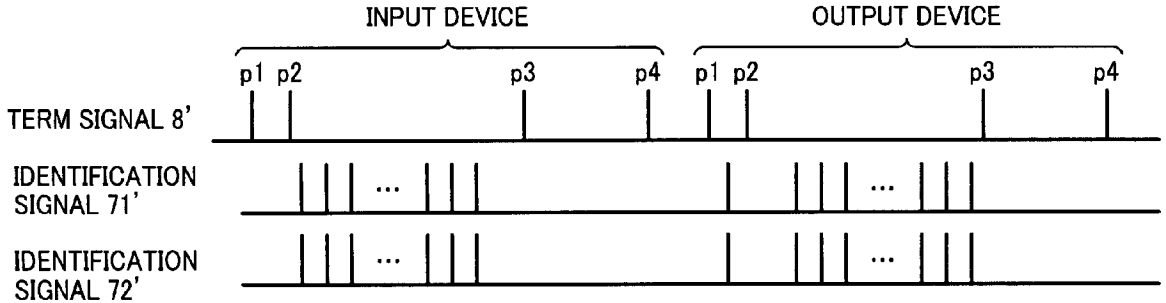
FIG. 6 is an example timing chart that shows the identification signal sent from two identifications signal lines.
FIG. 7 shows example identification ID generated from two identification signals.

In the method of identification shown in FIG. 4, the time required for the identification becomes longer, when the I/O (Input/Output) increases. The reason is that the number of identification pulse increases. The number of the I/O (Input/Output) reaches about 200 in the image forming apparatus used the method of electrophotography. 200 pulses may be generated in the identification term, if all of the I/O (Input/Output) are identified by only one image forming controller. Moreover, the counter 33 for identification increases, too. Then, the signal line 7 may be increased, for example, to two, as shown in FIG. 6. And the pulse of each identification signal 71' and 72' may be converted into code and used to calculate the identification ID. It only has to identify the I/O (Input/Output) by the identification ID. For example, the I/O (Input/Output) of 256 or less can identify 16 pulses, if 16 pulses can be calculated by each identification signal line, as shown in FIG. 7. As a result, the identification term can be shortened. The identification signal 72' may be allocated to a high order bit string, and the identification signal 71' may be allocated to the low order bit string, if the pulse of identification signal is converted the bit string. As a result, the conversion code becomes "0000" in the high order bit string and the low order bit string, when both of the identification signal 71' and 72' is "0". Furthermore, the conversion code becomes "0011" in the high order bit string and "1011" in the low order bit string, when the pulse of the identification signal 72' is "3" and the pulse of the identification signal 71' is 11. In example embodiments, the identification ID identifies the I/O (Input/Output) whose number is "59".

Figure 8A:
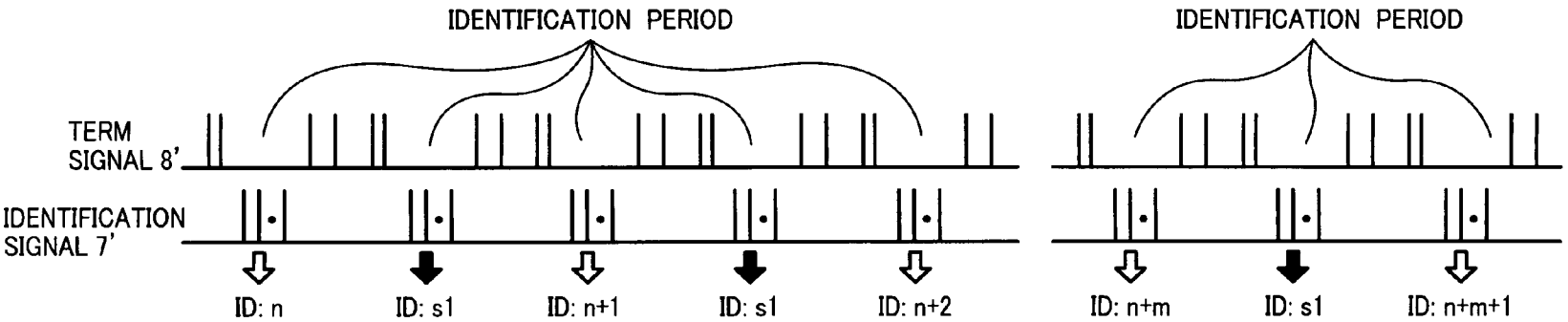
FIGS. 8A-8C show an example identification signal that calls the peculiar detector that generates the interrupt signal.

The image forming apparatus recognizes the I/O (Input/Output) of the drivers 4*a*-4*n* and the detectors 5*a*-5*x*. As a result, it is possible to transmit and receive data by only one data line between the drivers 4*a*-4*n* and the detectors 5*a*-5*x*. However, it is only time that the image forming controllers 2 needs the data, when the image forming apparatus transmit and receive the data to each driver 4*n* and detector 5*x*. The image forming apparatus may rarely have the I/O (Input/Output) that give and receive the data to image forming controller 2 generates the interrupt signal. For example, the interrupt signal may be an error signal, detection signal of a feeder, detection signal of intermediate transfer device. The particular identification ID may be added to the particular kind of corresponding I/O (Input/Output). For example, the particular identification ID is s1 shown in FIG. 8A. Thus, it is possible for an image forming apparatus to appropriately correspond to the particular kind of detector 5.

Figure 8B:
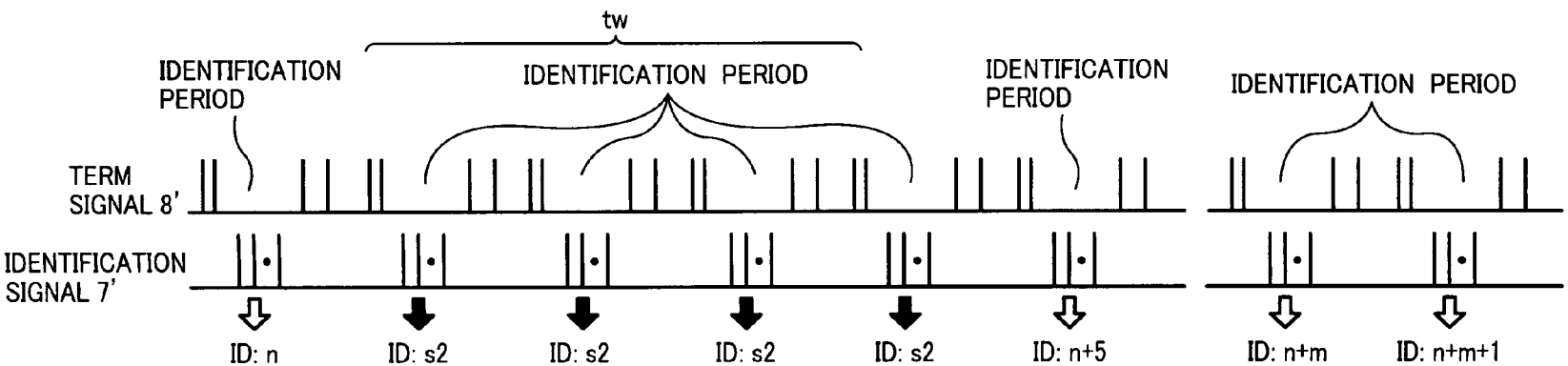
Figure 8C:
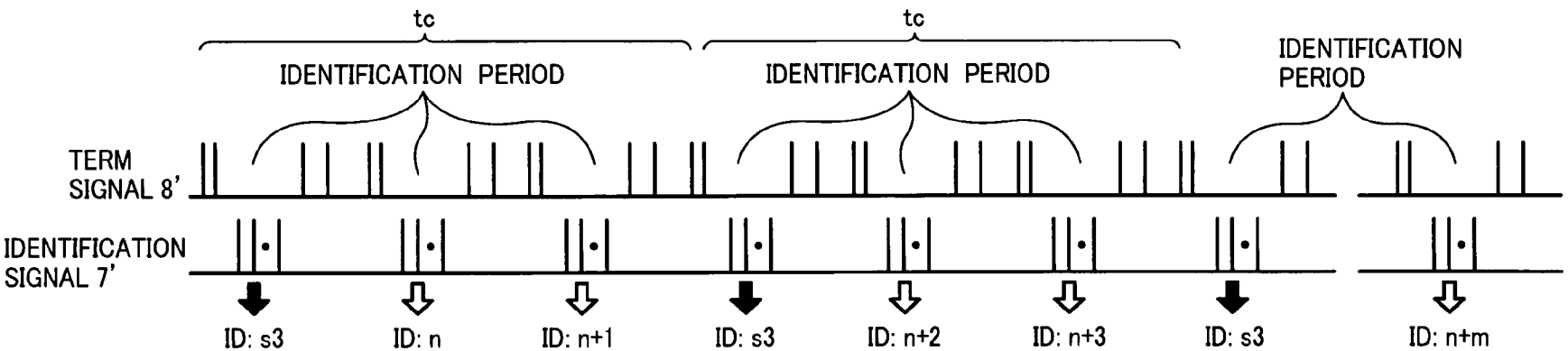

The particular kind of the detector 5 may have a variety of detection units. For example, one detector cannot expect the time that generates the error signal. And other detection units may preliminarily expect the time that generates interrupt signal. So the identification ID may be added to the detector that can expect the time. For example, the identification ID may be "s2". And the identification ID may be added to the detector that cannot expect the time. For example, the identification ID is "s3". The detector added the identification ID "s2" is continuously called more than once at the time "tw" that expected the difference of the generation of the signal shown in FIG. 8B. The detector added the identification ID "s3" is called at the cycle "tc" does not become a problem from the generation of the signal to processing shown in FIG. 8C.

It is desirable for detector 5 to allocate few identification pulses preferentially, because the interrupt signal is promptly taken from the detector 5.

When image is formed by the image forming apparatus 1, each composition unit which composes the image forming apparatus performs in the same motion. Identification ID is sequentially appended to driver 4*a*-4*n* and detector 5*a*-5*x* responsive to the same motion shown in FIG. 9. Furthermore, identification ID is multiplexed. The image forming apparatus had better have the function that the number of adjacent identification pulse counted by the counter 33 is stored in the identification controller 3. In example embodiments, it is possible to call the next I/O (Input/Output) device by adding one to the stored number of identification pulses, when the image forming apparatus performs the same function. It has to generate only one pulse as an identification signal. As a result, it is possible to shorten the latency of the I/O (Input/Output) devices. In example embodiments, the detector 5 which anticipates interrupt signal generates a packet. The packet shown in FIG. 9 does not contain the pulse in the period when identification is effective. As a result, it is possible for detector 5 to be called repeatedly.

It is stopped to reset the counter device 33 of each packet by the reset signal shown in FIG. 3. And the identified signal is counted when Detect signal is for the period of "H". Furthermore, the calculation value of the period is retained, when Detect signal is for the period of "L". As a result, identification controller 3 has the function of storing identification ID immediately before. However, the signal multiplexing is not used for the I/O (Input/Output) device that generates the error signal that cannot be anticipated. In this case, it treats as an individual input signal.

Figures 9, 10:
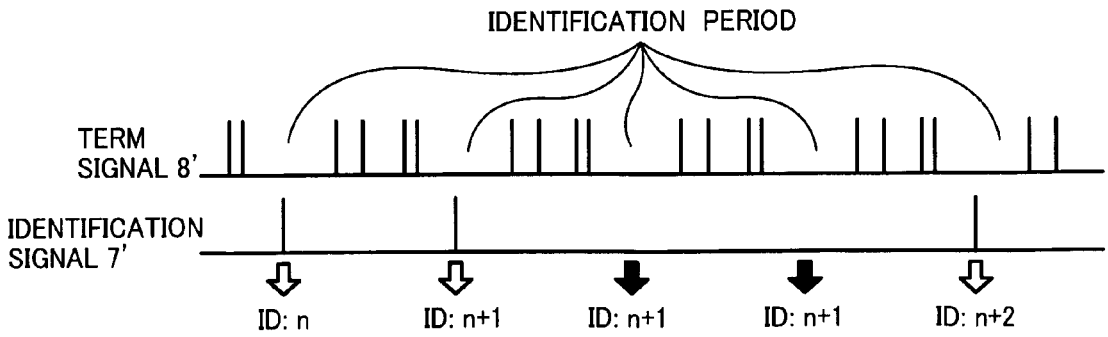
FIG. 9 shows an example identification ID added to the I/O device correspond to series of operation the image forming apparatus perform.
FIG. 10 shows an example identification signal when the detector to be able to anticipate the interrupt signal is called.
Figure 11:
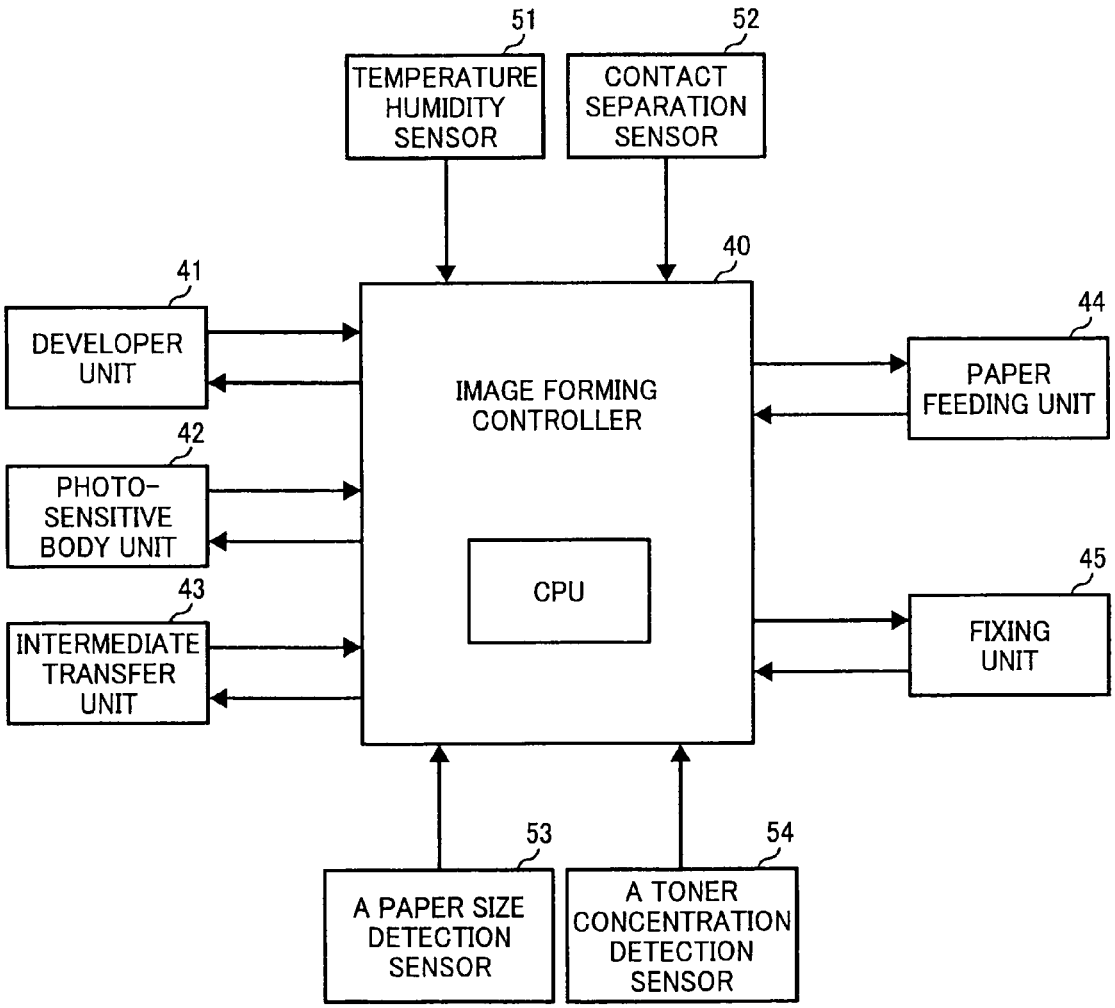
FIG. 11 Prior Art
FIG. 11 is a block diagram showing the configuration of a conventional image forming apparatus.

In example embodiments, it is possible to call repeatedly by generating a packet which does not contain a pulse in the identification effective term shown in FIG. 10 (see black arrow).

Example embodiments have been described in detail; however, example embodiments are not limited thereto. Those skilled in the art will appreciate that various modifications and variations may be possible, without departing from the scope and spirit of the appended claims.

What is claimed is:

1. An image forming apparatus comprising:

an image forming controller configured to control a movement of the image forming apparatus;

plural drivers configured to drive plural actuators;

an identification controller configured to be coupled to a data signal line, an identification signal line and a term signal line;

wherein the identification controller is configured to identify one of the plural drivers based on a term signal and an identification signal that are output from the image forming controller, and to output a driving signal from the image forming controller to the identified driver.

2. The image forming apparatus as claimed in claim 1 further comprising:

plural detectors configured to detect a condition of the image forming apparatus;

wherein the identification controller is configured to identify binary data which is input from the plural detectors based on the term signal and the identification signal that is output from the image forming controller, and to output the identified binary data to the image forming controller via the data signal line.

3. The image forming apparatus as claimed in claim 2, wherein the data signal line is configured to transfer an input signal and a driving signal to the plural detectors.

4. The image forming apparatus as claimed in claim 2, wherein the identification signal line is configured to transfer an identification signal that identifies one of the plural detectors.

5. The image forming apparatus as claimed in claim 2, wherein the term signal line is configured to transfer a term signal that specifies effective term of the data in the data signal line, identification effective term that indicates an effectiveness of the identification signal output from the identification signal line, and input/output determination term that determines whether it inputs to the plural detectors or not.

6. The image forming apparatus as claimed in claim 2, wherein the identification controller is configured to count a number of identification pulses that is input via the identification signal line, and to identify one of the plural detectors or the drivers based on the result of the count.

* * * * *